United States Patent [19]

Hillinger et al.

[11] Patent Number: 4,758,248

[45] Date of Patent: Jul. 19, 1988

[54] GASIFICATION OF FINE-GRAINED OR SLUDGY CARBONACEOUS MATERIAL

[75] Inventors: Bruno Hillinger, Hinterbrühl; Georg Beckmann, Vienna, both of Austria

[73] Assignee: Waagner-Biro A.G., Austria

[21] Appl. No.: 931,992

[22] Filed: Nov. 18, 1986

Related U.S. Application Data

[63] Continuation of Ser. No. 714,248, Mar. 21, 1985, abandoned.

[30] Foreign Application Priority Data

Mar. 22, 1984 [AT] Austria ..... 962/84

[51] Int. Cl.[4] ..... C10J 3/06

[52] U.S. Cl. ..... 48/197 R; 48/202; 48/209

[58] Field of Search ..... 48/197 R, 202, 203, 48/206, 209, 210, DIG. 1, DIG. 7; 34/9.5, 39, 40

[56] References Cited

U.S. PATENT DOCUMENTS

| | | | |
|---|---|---|---|
| 189,576 | 4/1877 | Rigby | 48/206 |
| 538,908 | 5/1895 | Gobbe | 48/206 |
| 795,874 | 8/1905 | Whitfield | 48/DIG. 1 |
| 906,793 | 12/1908 | Greerstreet | 48/202 |
| 1,977,684 | 10/1934 | Lucke | 48/206 |
| 2,175,613 | 10/1939 | Radtke | 48/202 |
| 2,591,595 | 4/1952 | Ogorzaly | 48/206 |
| 4,464,183 | 8/1984 | Arisaki | 48/210 |

*Primary Examiner*—Peter Kratz

*Attorney, Agent, or Firm*—Steinberg & Raskin

[57] ABSTRACT

Method for gasifying carbonaceous fine-grained or sludgy material, such as powdered brown coal or biomass, in fixed bed reactors. Carbonaceous material to be gasified is pre-heated and dried, and mixed with coarse-grained, non-carbonaceous ballast material. This mixing is carried out prior to, during or after the pre-heating and drying of the carbonaceous material, to thereby obtain a pre-heated and dried mixture of the carbonaceous material and the ballast material, and to also obtain vapor from the pre-heating and drying of the same. The heated and dried mixture is contacted with a gasification medium within a fixed bed reactor, at a temperature sufficiently high to gasify the carbonaceous material. The gasification medium includes the vapor from the pre-heating and drying of the carbonaceous material. The ballast material provides sufficient gas permeability to the fine-grained or sludgy carbonaceous material, to permit gasification thereof in the fixed bed reactor.

13 Claims, 1 Drawing Sheet

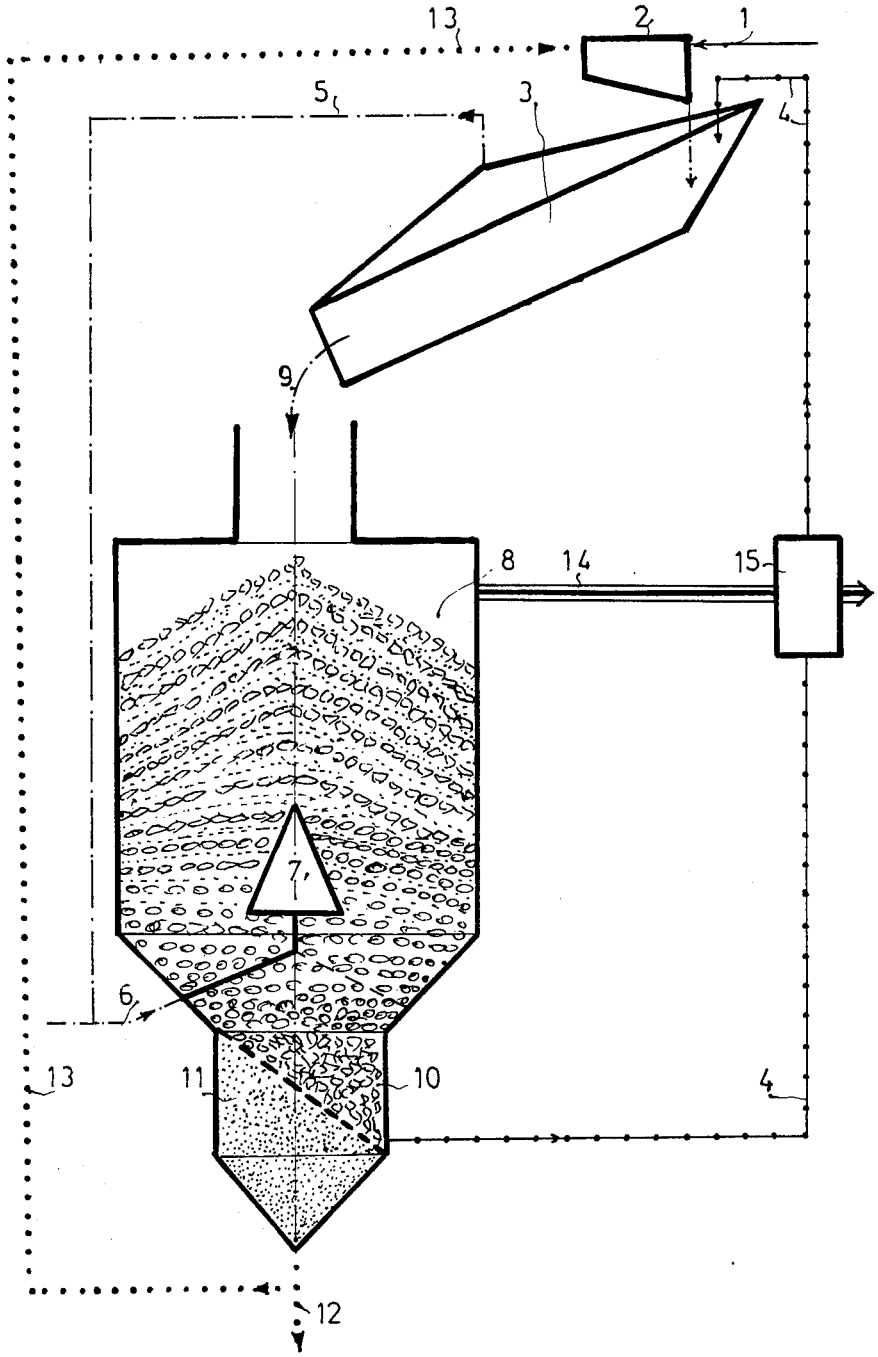
13
2
1
5
3
4
9
8
14
15
7
6
13
11
10
4
12

GASIFICATION OF FINE-GRAINED OR SLUDGY CARBONACEOUS MATERIAL

This is a continuation of application Ser. No. 714,248, filed 3/21/85, abandoned.

BACKGROUND OF THE INVENTION

The present invention relates to a method for gasifying carbonaceous fine-grained or sludgy material, such as powdered brown coal or biomass, within fixed bed reactors, wherein the carbonaceous material to be gasified is pre-heated and dried, especially prior to introduction into the fixed bed reactor, with the vapors resulting from the pre-heating and drying being admixed with the gasification medium, while the carbonaceous material to be gasified is mixed with coarse-grained ballast material either within or prior to introduction into the fixed bed reactor, to improve the gas permeability of the fine-grained or sludgy carbonaceous material.

It is known to burn and/or gasify carbonaceous material, e.g. within a gasification reactor. The gasification reactor must be charged with material of a given minimum granular size. Material having a smaller granular size will result in inadequate gasification, thus considerably reducing the effectiveness of a gasification plant. Moreover, the material to be gasified should have a minimum ash content, so that after passing through the gasification zone, there is adequate material for gas distribution as well as for gas heating.

For the above reasons, various kinds of dust, sawdust or sewage sludge can be gasified only to an extremely limited extent, and supplied for heat-economical use. Wash refuse, which is developed in coal mining, is similarly unsuitable for gasification, due to the low carbon content thereof, and is thus virtually suitable only as a deposit.

In order to counteract these disadvantages, powdery fuels are usually briquetted. The briquettes may be produced in a gas-permeable (tubular) shape (DE-OS No. 22 56 383). Alternatively, a gasification retort is charged alternately with fine-grained and coarse-grained material, in order to improve the gas permeability (DE-PS No. 168,873, AT-PS No. 64,423).

SUMMARY OF THE INVENTION

Accordingly, it is an object of the present invention to improve gasification of fuel.

It is also an object of the present invention to counteract the above-noted disadvantages.

It is another object of the present invention to enable gasification with a wider range of fuel.

It is a further object of the present invention to provide for effective gasification with fine-grained or sludgy fuel.

It is also another object of the present invention to provide for effective gasification of fuel having low ash content.

It is also a further object of the present invention to improve utilization of the products of gasification of fuel.

These and other objects are obtained by the present invention which provides a method for gasifying carbonaceous fine-grained or sludgy material, such as powdered brown coal or biomass, in fixed bed reactors, which comprises pre-heating and drying the carbonaceous material to be gasified, and mixing the carbonaceous material with a coarse-grained, non-carbonaceous, ballast material. The mixing is carried out prior to, during, or after pre-heating and drying of the carbonaceous material, to thereby obtain a pre-heated and dried mixture of the carbonaceous material and the ballast material. Vapors from the pre-heating and drying of the carbonaceous material are also obtained.

The heated and dried mixture is contacted in a fixed bed reactor with a gasification medium, at a temperature sufficiently high to gasify the carbonaceous material. The gasification medium includes the vapors from the pre-heating and drying of the carbonaceous material. The ballast material provides efficient gas permeability to the fine-grained or sludgy carbonaceous material, to permit gasification thereof in the fixed bed reactor.

The ballast material mixed with the carbonaceous material, may be constituted by new ballast material introduced into the gasification system for the very first time, or it may be constituted, at least in part, by recycled ballast material that has been separated from ash from within the fixed bed reactor. The separated ash may be deposited upon the carbonaceous material to be gasified, prior to pre-heating and drying of the same. More particularly, the ballast material may be constituted by wash refuse or limestone with a granular size exceeding 10 mm, which, after separation from the ash, can be used in its granular state for different purposes. The ash from the fixed bed reactor, together with the fines of the ballast material, may be deposited upon the moist carbonaceous material to be gasified, with which the ash is then reacted. The magnesium and calcium oxides contained within the ash are hydrated by the moisture of the carbonaceous material to be charged, with this carbonaceous material to be gasified being pre-heated and partially dried by the heat of reaction. In this regard, the features of the present invention are described in further detail below.

It has also been surprisingly found that the problems of tar, which are inherent in the generated gas from the gasification method, can also be solved by the present invention. More particularly, the ballast material to be charged is directly heated by the gas generated from within the fixed bed reactor. This causes droplets of tar to condense along the surfaces of the ballast material, such condensed tar again being introduced into the fixed bed reactor, along with the ballast material in which the tar is partially combusted or gasified. By directly contacting cold ballast material with the gas generated from within the fixed ractor, prior to mixing the ballast material with a carbonaceous material, the ballast material may be concomittantly pre-heated with the tar precipitating along the surfaces of the ballast material as noted. This improves adherence of the carbonaceous material to the ballast material during the subsequent mixing, also serves to heat the carbonaceous material upon the subsequent mixing, and even serves to heat the gasification medium within the fixed bed reactor between the inlet of the gasification medium and the gasification zone within the fixed bed reactor.

BRIEF DESCRIPTION OF THE DRAWING

The accompanying drawing is a schematic illustration of an embodiment of the present invention.

DETAILED DESCRIPTION OF THE PREFERRED EMBODIMENTS

Referring to the drawing, the material to be gasified is fed to a drier 3 via a feed line 1 and a mixer 2. The drier 3 may be, for example, a heated oscillating chute, in which the material to be dried is dried and pre-heated by addition of heat. Together with the material to be gasified, coarse-grained ballast material, e.g. pre-heated iron spheres, limestone and even wash refuse, is also fed to the drier via the line 4. The ballast material and the carbonaceous material to be gasified are then intimately mixed within the oscillating chute of the drier 3.

Since the coarse-grained ballast material has a higher temperature than the material to be gasified, additional heat will be supplied, thus producing the drying effect. The vapors generated within thc drier 3 are exhausted via the steam line 5, and added to the gasification medium which is fed via the feed line 6 into the gas distributor 7, located within the gasifier proper 8. The pre-dried material is transferred, as indicated by arrow 9, from the drier 3 to the gasifier 8, where the material is deposited in layers, with the temperature from the top to the bottom layers increasing in the direction of the actual gasification zone. After the gasification zone, the temperature again decreases, until the temperature reaches the approximate feed temperature of the gasification medium in the region of the gas distributor 7.

The degassed material then enters the separation zone 10, which is provided with a sieve 11 for separating the coarse-grained ballast material from the produced ash. The ballast material is then fed to a pipe 4, while the ash is exhausted via the ash removal line 12, or, in particular when the ash has a strong calcium oxide or magnesium oxide content, recirculated via the line 13 and fed into the mixer 2 where the magnesium oxide or calcium oxide reacts with the moisture of the material to be gasified. Consequently, the material to be dried, and then subsequently gasified, is already heated within the mixer 2, while the calcium oxide or magnesium oxide is hydrated.

The combustible hot gas generated within the gasifier 8 is exhausted via the line 14 and cooled in a heat exchanger 15, while the heat is transferred to the coarse-grained ballast material, so that a portion of the heat is used for pre-heating or drying the material to be gasified.

Especially suitable for use as ballast material, are artificial ballast materials such as metallic bodies, e.g. iron bodies, ceramics, or expanded clay bodies, in all types of shapes or forms, e.g. in the form of spheres. However, natural ballast materials, such as wash refuse or limestone, may also be used instead of artificial ballast materials. The use of wash refuse will result in an additional charge of material to be gasified, in the form of inclusion of coal, while the part of the wash refuse which is not to be gasified, insofar as it does not contain limestone or magnesite, may also be used.

On the other hand, if limestone is used, this method allows the firing of limestone within the gasifier, so that anhydrous lime is generated in the form of coarse-grained ballast material, as a consequence of which the recirculation line illusstrated in the drawing is concomitantly interrupted, and only raw lime is supplied through the heat exchanger 15.

The gas permeability within the gasifier is improved due to the supply of coarse-grained ballast material, whereby an even distribution of temperature is achieved within the gasifier, thus insuring improved effectiveness of gasification. However, the method according to the present invention also enables gasification of fuels with an extremely low ash content, which, for instance, are used in bio-engineering, whereby dehydrated bagasse becomes gasifiable.

Moreover, when executing the present method, it becomes apparent that the droplets of tar, which are removed by the hot gas from the gasifying reactor, are partially conveyed within the heat exchanger to the relatively cold ballast material, due to precipitation along the surfaces thereof. Thus the ballast material becomes tacky, so that the carbonaceous dust to be gasified adheres thereto. This leads to a reduction of the dust fraction, so that the dust fraction initially within the material to be gasified, can be increased. The recirculated tar is consequently again fed into the gasifier 8, where, due to contact with the gasifying medium, the tar can partially be converted into combustible gas, or can be directly used as fuel, whereby the tar in circulation can be automatically maintained at a certain level.

The artificial ballast material, i.e. the metallic or ceramic bodies, preferably has a granular size exceeding 10 mm. The recycled ballast material will also preferably have a granular size exceeding 10 mm. This ballast material may be recycled directly to the fixed bed reactor 8 or drier 3 while hot, or first passed through the heat exchanger 15, after being separated from the ash.

The preceding description of the present invention is merely exemplary, and is not intended to limit the scope thereof in any way.

What is claimed is:

1. Method for gasifying carbonaceous fine-grained or sludgy material, such as powdered brown coal or biomass, in fixed bed reactors, comprising pre-heating and drying said carbonaceous material to be gasified and mixing said carbonaceous material with a coarse-grained ballast material, said mixing being effected prior to, during or after the pre-heating and drying of said carbonaceous material, thereby obtaining a pre-heated and dried mixture of said carbonaceous material and said ballast material, and also obtaining vapors from the pre-heating and drying of said carbonaceous material, contacting said heated and dried mixture in a reaction zone or a fixed bed reactor with a gasification medium at a temperature sufficienty high to remove any water from said mixture and form ash and sufficiently high to gasify said carbonaceous material, said gasification medium including vapors from the pre-heating and drying of said carbonaceous material, whereby said ballast material provides sufficient gas permeability to fine-grained or sludgy carbonaceous material to permit gasification thereof in the fixed bed reactor, and recycling at least a part of said ash as it emerges from said reaction zone for use in said mixing with said carbonaceous material for the thus recycled ash to accept moisture from the carbonaceous material and thus contribute to the drying thereof and to be converted into its hydrated state, and for the thus hydrated ash to introduce the accepted water into said reaction zone to participate in the gasification of the carbonaceous material thereat.

2. The method of claim 1 wherein said recycled ash included in the ballast material includes wash refuse having a granular size at least about 10 mm.

3. The method of claim 1, additionally comprising separating ballast material from ash from within the fixed bed reactor, said recycling step including supplying at least a portion of the thus-separated ash to said mixing step.

4. The method of claim 3, wherein said supplying step includes depositing the thus-separated ash upon said carbonaceous material to be gasified, prior to the pre-heating and drying of the same, whereby magnesium and calcium oxides contained within the ash are hydrated by moisture from said carbonaceous material, which is in turn, pre-heated and partially dried.

5. The method of claim 3, additionally comprising recycling the thus-separated ballast material for mixing with said carbonaceous material.

6. The method of claim 1, wherein said carbonaceous material and said ballast material are mixed within a heated, oscillating chute.

7. The method of claim 1, additionally comprising directly contacting cold ballast material with gas generated from within the fixed bed reactor, prior to mixing said ballast material with said carbonaceous material, whereby said ballast material is pre-heated and tar precipitates on the surfaces of said ballast material, thus improving adherence of said carbonaceous material to said ballast material during the subsequent mixing of the same, serving to heat said carbonaceous material upon the subsequent mixing, and serving to heat the gasification medium within the fixed bed reactor between the inlet of the gasification medium and the gasification zone within the fixed bed reactor.

8. The method of claim 5, wherein said separated and recycled ballast material has a granular size at least about 10 mm.

9. The method of claim 1 wherein said ballast material has a granular size at least about 10 mm.

10. The method of claim 1, comprising the additional step of circulating the vapors generated during said drying step to said gasification medium via a separate line.

11. Method for gasifying carbonaceous fine grained or sludgy material such as powdered brown coal or biomass, in fixed bed reactors, comprising pre-heating and drying said carbonaceous material to be gasified, and mixing said carbonaceous material with a coarse-grained ballast material including limestone, said mixture being effected prior to, during or after the pre-heating and drying of said carbonaceous material, thereby obtaining a pre-heated and dried mixture of said carbonaceous material and said ballast material, and also obtaining vapors from the pre-heating and drying of said carbonaceous material.

contacting said heated and dried mixture in a reaction zone of a fixed bed reactor with a gasification medium at a temperature sufficiently high to remove any water from said mixture to form anhydrous lime and sufficiently high to gasify said carbonaceous material, said gasification medium including vapors from the pre-heating and drying of said carbonaceous material, whereby said ballast material provides sufficient gas permeability to said fine-grained or sludgy carbonaceous material to permit gasification thereof in the fixed bed reactor, and recycling at least a part of said anhydrous lime as it emerges from said reaction zone for use in said mixing with said carbonaceous material for the thus recycled anhydrous lime to accept moisture from the carbonaceous material and thus contribute to the drying thereof and to be converted into its hydrated state, and for the thus hydrated substance to introduce the accepted water into said reaction zone to participate in the gasification of the carbonaceous material thereat.

12. The method of claim 11, wherein said limestone has a granular size at least about 10 mm.

13. The method of claim 11, comprising the additional step of circulating the vapors generated during said drying step to said gasification medium via a separate line.

* * * * *